US008671963B2

(12) United States Patent
Shih

(10) Patent No.: US 8,671,963 B2
(45) Date of Patent: Mar. 18, 2014

(54) OVERHEAD COMBINED TENT STRUCTURE

(75) Inventor: Feng-Ming Shih, Taichung (TW)

(73) Assignee: DA Ding Energy Co., Ltd., Taichung (TW)

( * ) Notice: Subject to any disclaimer, the term of this patent is extended or adjusted under 35 U.S.C. 154(b) by 299 days.

(21) Appl. No.: 13/232,472

(22) Filed: Sep. 14, 2011

(65) Prior Publication Data

US 2012/0000498 A1 Jan. 5, 2012

Related U.S. Application Data

(63) Continuation-in-part of application No. 12/509,463, filed on Jul. 25, 2009, now abandoned.

(51) Int. Cl.
*E04H 15/04* (2006.01)
*E04H 15/56* (2006.01)

(52) U.S. Cl.
USPC ..... 135/90; 135/901; 135/137; 135/148

(58) Field of Classification Search
USPC ..... 135/88.17, 90, 96, 137, 142, 148, 901; 43/1; 211/196, 205; 182/115, 116, 126
See application file for complete search history.

(56) References Cited

U.S. PATENT DOCUMENTS

| | | | | |
|---|---|---|---|---|
| 3,068,046 | A * | 12/1962 | Bourgoin | 296/95.1 |
| 5,218,982 | A | 6/1993 | Kenji | |
| 5,853,066 | A | 12/1998 | Gohn | |
| 6,192,909 | B1 * | 2/2001 | Strausser | 135/137 |
| 6,434,877 | B1 | 8/2002 | Shelton | |
| 7,958,968 | B1 * | 6/2011 | Stabler | 182/187 |
| 8,220,197 | B1 * | 7/2012 | Pray | 43/122 |
| 2002/0078988 | A1 * | 6/2002 | Valpredo | 135/90 |
| 2009/0277721 | A1 | 11/2009 | Weir | |

* cited by examiner

*Primary Examiner* — David R Dunn
*Assistant Examiner* — Danielle Jackson
(74) *Attorney, Agent, or Firm* — Egbert Law Offices, PLLC

(57) ABSTRACT

An overhead combined tent structure having a snap ring sleeved securely onto a vertical columnar object and which contains an adjustable clamping portion. A soft lining is assembled between the snap ring and vertical columnar object. A tent skeleton is composed of a plurality of racks and is extended outwards by taking the snap ring as a pivot and assembled crisscross to define a floor area. A plurality of single-opening connectors are used to connect the snap ring with various racks of the tent skeleton. The vertical plate is clamped by the snap ring and abutted externally onto the soft lining. A supporting leg assembly is linked to the floor area of the tent skeleton, made of a plurality of adjustable supports and protruded vertically to form a landing end. A universal swinging footstand is mated with the landing end of the adjustable support in a universal swinging state.

4 Claims, 7 Drawing Sheets

OVERHEAD COMBINED TENT STRUCTURE

CROSS-REFERENCE TO RELATED U.S. APPLICATIONS

The present application is a continuation-in-part of U.S. patent application Ser. No. 12/509,463, filed on Jul. 25, 2009, and entitled "Overhead Combined Tent Structure", presently pending.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a combined tent, and more particularly to an innovative one which allows at least a snap ring to be sleeved securely onto the vertical columnar object, such that the combined tent can be used overhead without limitation by the ground state.

2. Description of Related Art Including Information Disclosed Under 37 CFR 1.97 and 37 CFR 1.98

In recent years, more and more outdoor activities are welcomed by the general public, particularly the camping activities by the youth. However, conventional tents erected on the ground are limited by oblique or uneven surface during assembly, leading to discomfort against the users.

As for the campers, short-terms workers in mountains, ecological observers and refugees required to erect tents for temporary use, it is often difficult to find a piece of flat land, or otherwise it may take a longer time and more effort to level up the land, leading to slow erection of tents. Moreover, they have to clean up possible obstacles (including stones and weeds) on the flat land, without mentioning the common concern of disturbances by snakes, insects or other small animals, etc, in the ambient environment.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

A novel, overhead tent structure is provided to the users (e.g.: campers, short-terms workers in mountains, ecological observers and refugees) as a shelter. The overhead design enables flexible erection in response to the ground state. Moreover, various units can be assembled and disassembled very easily without the help of other hand tools. The disassembled units of smaller size could be carried, handled or transported conveniently. With the outstanding characteristics of the tent structure of the present invention, the users could select a proper site to erect tents, where applicable, according to the weather and geographical conditions.

Based on the construction of the overhead combined tent wherein the soft lining is set on the vertical columnar object, the vertical columnar object could be protected by the soft lining, e.g.: if the vertical columnar object is a tree. The overhead combined tent of the present invention can thus be erected independently of the geographical condition while minimizing the damage to the ecological environment.

The structural design of said universal swinging footstand enables to obtain a stable erection point in tune with the slope of ground. When the tent skeleton and supporting leg assembly swing due to air stream or earthquake, the universal swinging footstand could swing in tune with the overhead structure and keep stable the pivot, thus improving greatly the resistance of the overhead combined tent to wind power and earthquake. The second advantage of said universal swinging footstand is that a stable erection point could be obtained in tune with the slope of ground to erect smoothly said overhead combined tent.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

FIGS. 1-4 depict preferred embodiments of an overhead combined tent of the present invention, which, however, are provided for only explanatory objective for patent claims.

Figure 1:
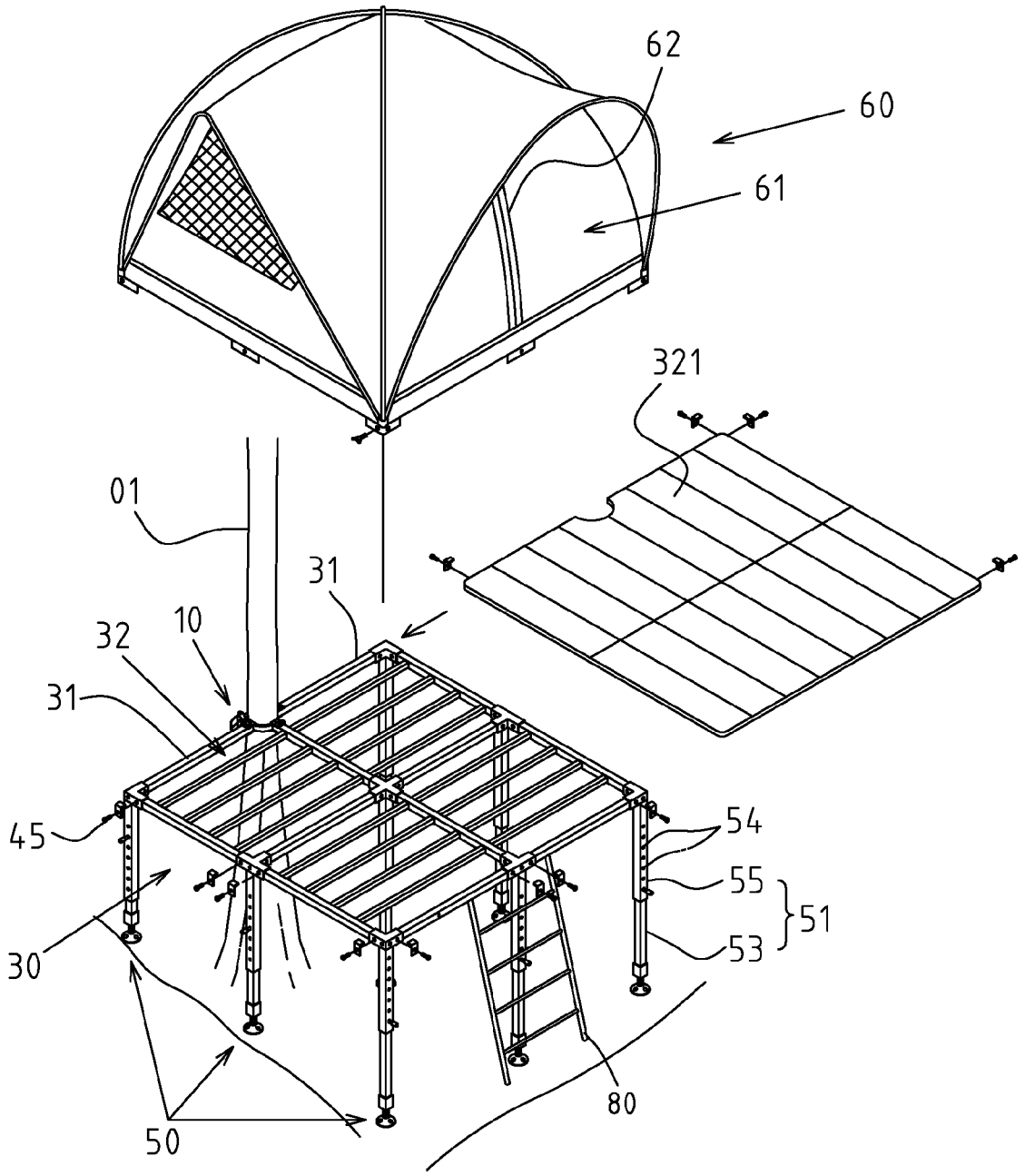
FIG. 1 is an exploded perspective view of the overhead combined tent of the present invention.
Figure 2:
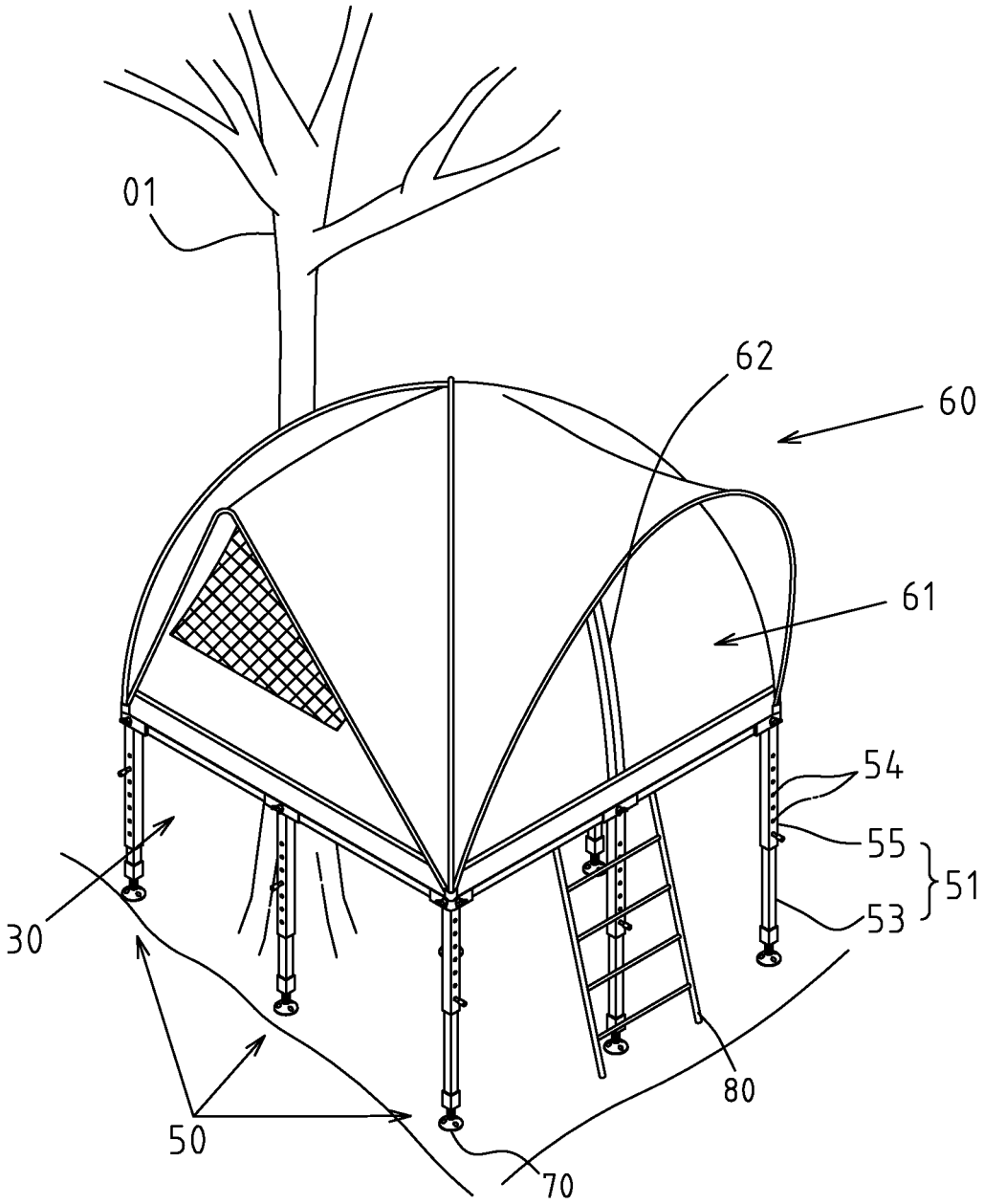
FIG. 2 is an assembled perspective view of the overhead combined tent of the present invention.
Figure 4:
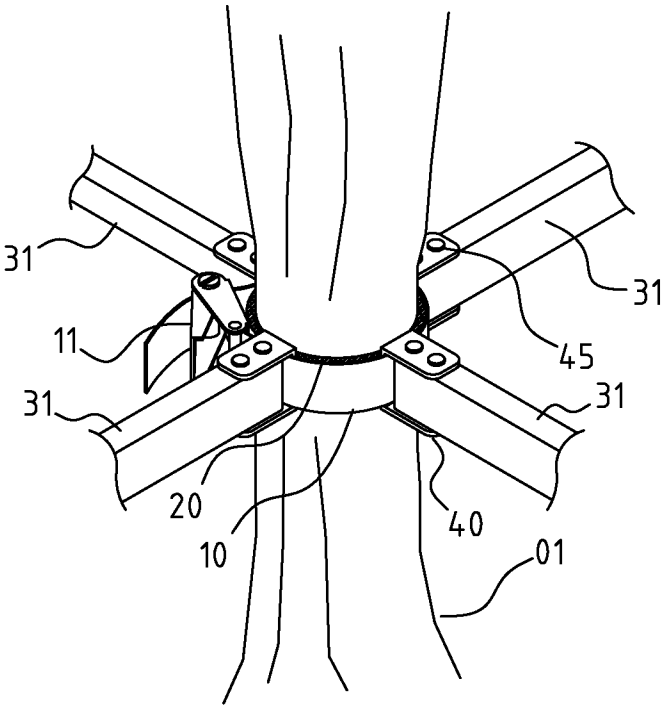
FIG. 4 is a schematic view of the snap ring of the present invention.
Figure 3:
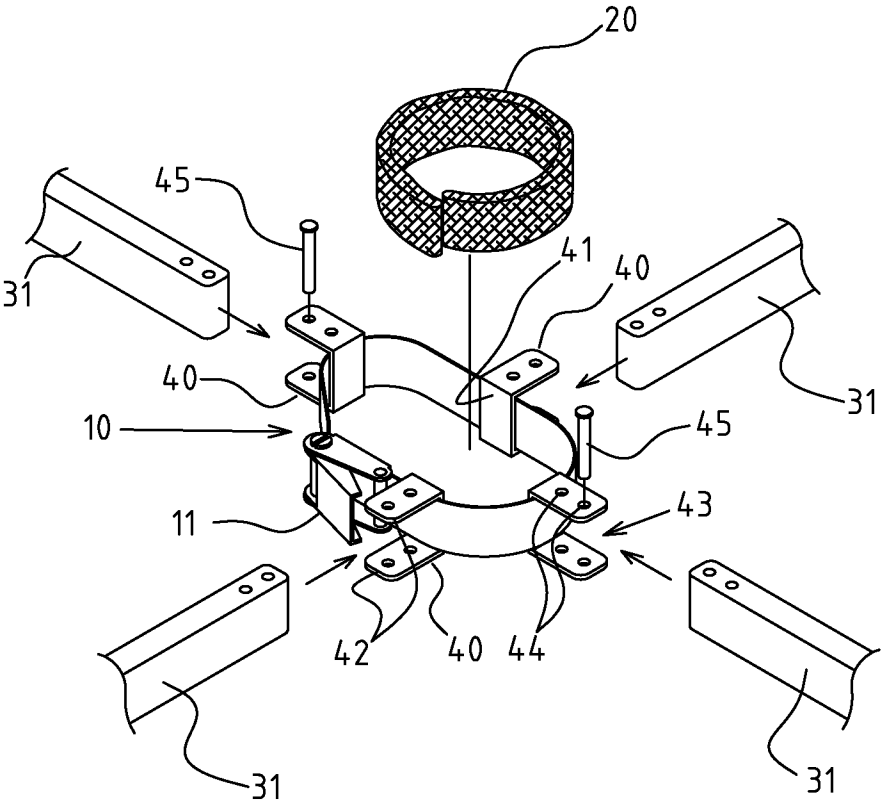
FIG. 3 is an exploded perspective view of the snap ring of the present invention.
Figure 5:
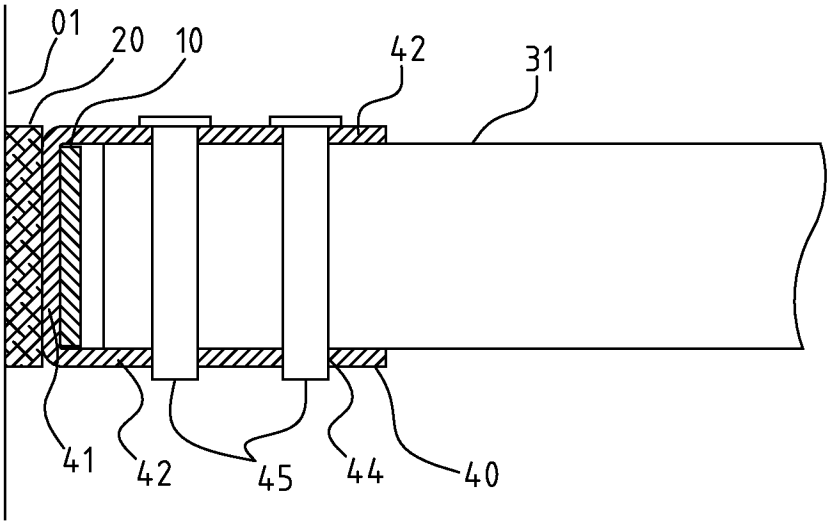
FIG. 5 is a detailed sectional view of the tent skeleton of the present invention.

The overhead combined includes at least a snap ring 10, which is sleeved securely onto a vertical columnar object 01 (the vertical columnar object 01 referred herein is a trunk, as disclosed in FIG. 1). The snap ring 10 contains an adjustable clamping portion 11, such that the snap ring 10 could be clamped onto the vertical columnar object 01, allowing for adjustment into a release state.

A soft lining 20 made of soft materials is assembled circularly between the snap ring 10 and vertical columnar object 01. The soft lining 20 is preferably made of non-woven fabric.

A tent skeleton 30 is composed of a plurality of racks 31. The tent skeleton 30 is extended outwards by taking the snap ring 10 as a pivot and assembled crisscross (shown in FIG. 4) to define at least a floor area 32. Said floor area 32 can be paved with sheets 321 as the floor or bedplate.

A plurality of single-opening connectors 40 are used to connect the snap ring 10 with various racks 31 of the tent skeleton 30. Said every connector 40 contains a vertical plate 41 and two transverse plates 42 (shown in FIG. 3) extended transversely by the upper and lower ends of the vertical plate 41. Of which, the vertical plate 41 is clamped by the snap ring 10 and abutted externally onto the soft lining 20. An opening 43 is formed between the ends of two transverse plates 42 to insert the end of the rack 31. Locating holes 44 are set correspondingly on two transverse plates 42 at the end of the rack 31, enabling connection and positioning by penetration of locating pin 45.

A supporting leg assembly 50 is linked to the floor area 32 of the tent skeleton 30, made of a plurality of adjustable supports 51 (shown in FIG. 6), and protruded vertically to form a landing end 52.

A coating cloth 60 is covered onto the tent skeleton 30 to form a living space 61. The coating cloth 60 is a moisture-proof tent cloth that is provided with an accessible door panel 62 (shown in FIGS. 1, 2).

Figure 10:
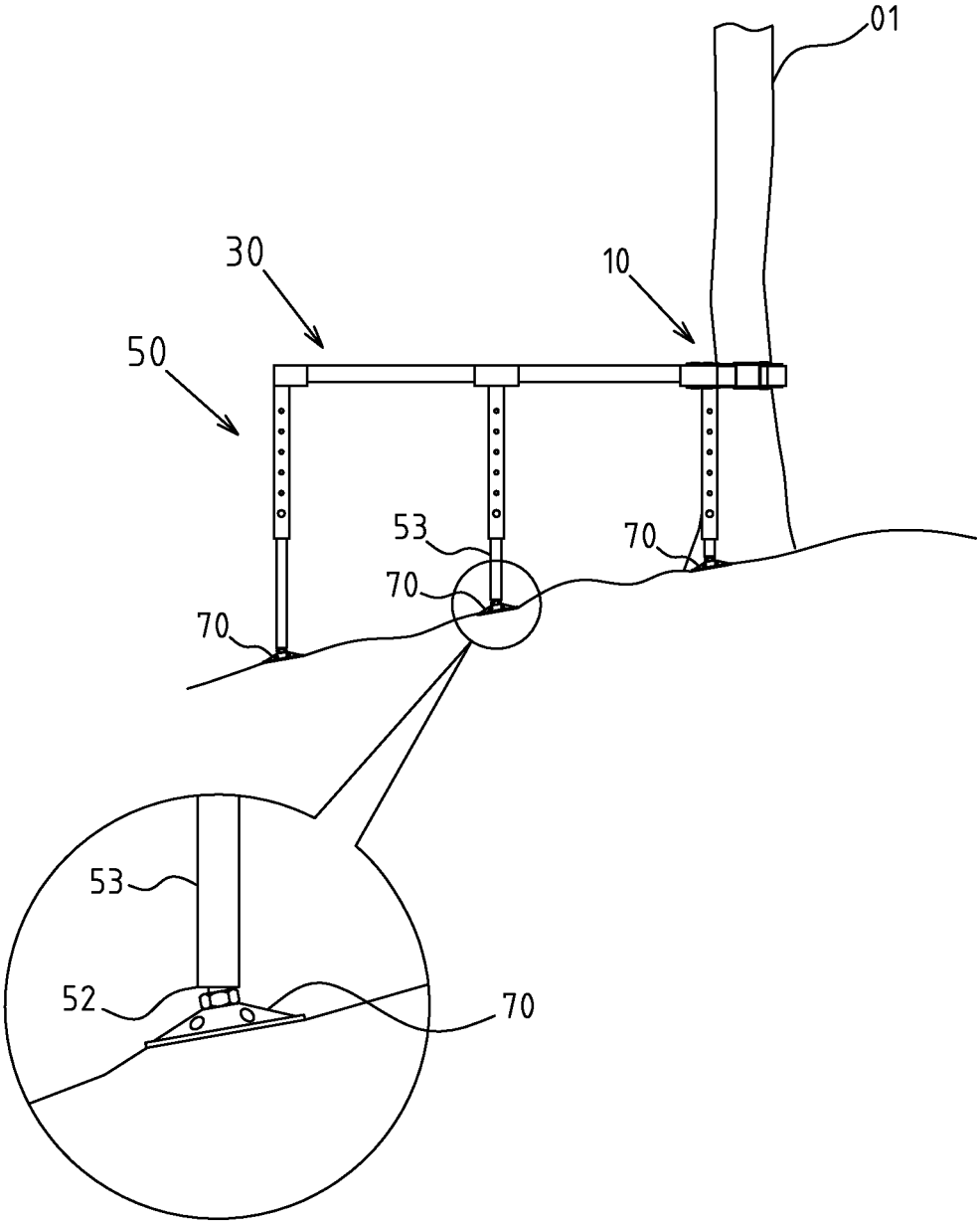
FIG. 10 is a schematic view of the overhead combined tent of the present invention.

A universal swinging footstand 70, as shown in FIG. 10, is mated with the landing end 52 of the adjustable support 51 in a universal swinging state.

Figure 8:
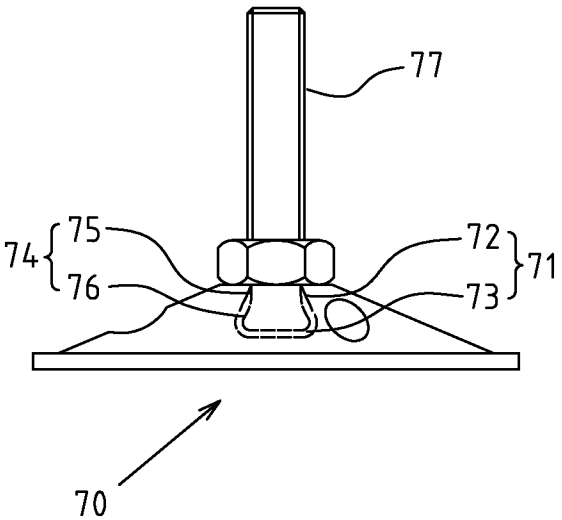
FIG. 8 is a perspective view of the footstand of the present invention.

Referring to FIG. 8, a tapered assembly slot 71 is set on the top of the footstand 70. The tapered assembly slot 71 contains a reducing port 72 and a tapered inner space 73 from top to bottom, such that the landing end 52 of the adjustable support 51 is provided with a tapered joint 74. The tapered joint 74 contains a necking portion 75 and a tapered head 76 from top to bottom. Of which, the necking portion 75 is mated with the reducing port 72 of the tapered assembly slot 71, while the tapered head 76 is mated with the tapered inner space 73 of the tapered assembly slot 71. A gap must be reserved between the tapered head 76 and tapered inner space 73.

Figure 7:
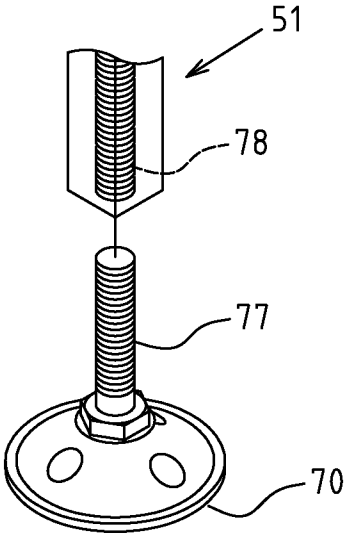
FIG. 7 is an exploded perspective view of the footstand of the present invention.

Referring to FIG. 7, a screwed section 77 is set at top of the tapered joint 74 on the landing end 52 of the adjustable support 51, so that a screw hole 78 is set onto the landing end 52 for bolting of the screwed section 77. The screwed section 77 is positively and reversely shifted in the screw hole 78 to fine tune the protruding length of the adjustable support 51.

Figure 6:
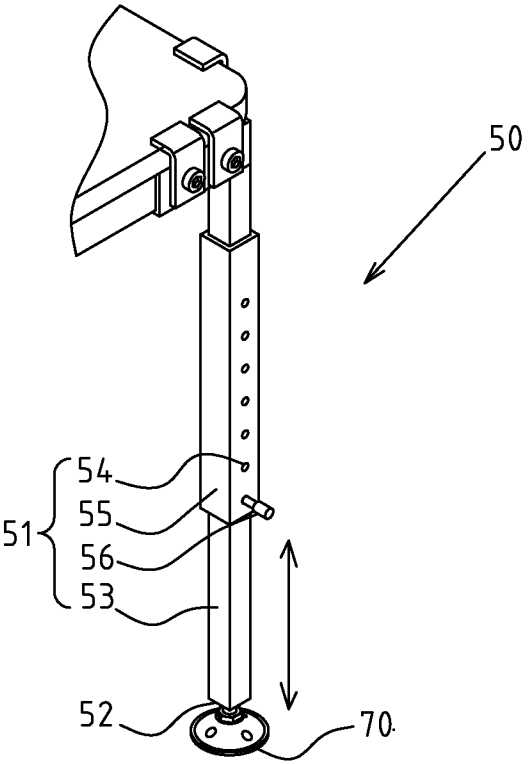
FIG. 6 is a schematic view of the supporting leg assembly of the present invention.
Figure 9:
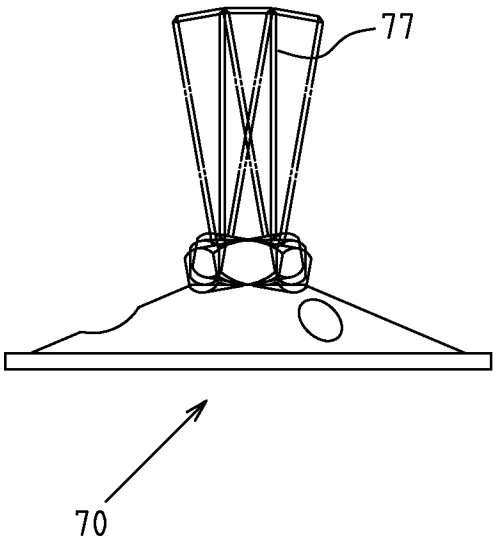
FIG. 9 is a schematic view of the footstand of the present invention.

Of which, the adjustable support 51 is provided with an expansion link 53 and a fixed support rod 55 with through-holes 54 (shown in FIG. 6). This allows to shift the expansion link 53 and then set into the through-hole 54 of the fixed support rod 55 via a fastener 56, thereby adjusting the overhead combined tent in response to the oblique ground.

Based upon above-specified structural design, the present invention is operated as follows:

When an overhead combined tent is to be erected, the snap ring 10 is firstly sleeved onto the vertical columnar object 01 and kept with a certain distance from the ground. A soft lining 20 is set between the snap ring 10 and vertical columnar object 01 to prevent damage of the vertical columnar object 01. Moreover, the vertical plate 41 of a plurality of connectors 40 is installed between the soft lining 20 and snap ring 10, and then a plurality of connectors 40 is clamped securely onto the vertical columnar object 01 by adjusting the adjustable clamping portion 11 of the snap ring 10. Next, by taking the snap ring 10 as a pivot, multidirectional racks 31 are extended from a plurality of connectors 40 (shown in FIG. 4), or by taking the snap ring 10 as the center (also shown in FIG. 4), racks 31 are developed to couple with simplified, multidirectional connectors (e.g.: T-shaped, crisscross and three-forked connectors). Referring also to FIG. 1, the supporting leg assembly 50 is assembled on the periphery of the floor area 32, and then adjusted flexibly by expansion link 53 and fixed support rod 55 of the adjustable support 51, such that the footstand 70 of the landing end 52 is supported reliably on the ground, thus finishing the erection of the overhead combined tent.

When the overhead combined tent is used, a plurality of sheets 321 is paved on the floor area 32 as a bedplate. Or, a ceiling structure is additionally set by paving a plurality of sheets on preset height over the floor area 32, then the coating cloth 60 is covered externally on the ceiling and floor area 32 to form said living space 61. The overhead combined tent is provided with ladder 80 for climbing by the users.

I claim:

1. An overhead tent apparatus comprising:

a vertical columnar object;

at least one snap ring sleeved securely onto said columnar object, the snap ring having an adjustable clamping portion such that the snap ring can be clamped to said columnar object, the clamping portion allowing the snap ring to be releasable from said columnar object;

a lining formed of a soft material, said lining arranged annularly between the snap ring and said columnar object;

a tent skeleton formed of a plurality of racks, said tent skeleton extendable outwardly, said tent skeleton having a crisscross area defining at least a floor;

a plurality of single-opening connectors connecting the snap ring with said plurality of racks of said tent skeleton, each of said plurality of single-opening connectors containing a vertical plate and a pair of transverse plates extending transversely by an upper end and a lower end of said vertical plate, said vertical plate clamped by the snap ring and externally abutting said lining, said pair of transverse plates defining an opening between the ends thereof, said opening receiving an end of at least one of the racks, said pair of transverse plates having locating holes at the end of the rack so as to allow connection and positioning by penetration therein of a locating pin;

a supporting leg assembly linked to said floor of said tent skeleton, said supporting leg assembly having a plurality of adjustable supports extending vertically to form a landing end;

a coating cloth covering said tent skeleton so as to define a living space therein; and a swinging footstand swingably mated with said landing end, said swinging footstand having a tapered assembly slot formed at a top thereof, said tapered assembly slot having a reducing port and a tapered inner space such that said landing end has a tapered joint, said tapered joint having a necking portion and a tapered head, said necking portion mated with said reducing port of said tapered assembly slot, said tapered head mated with said tapered inner space of said tapered assembly slot, said tapered head and said tapered inner space defining a gap therebetween.

2. The overhead tent apparatus of claim 1, said lining formed of a non-woven fabric.

3. The overhead tend apparatus of claim 1, said tapered joint having a screwed section set at a top thereof, said landing end having a screw hole formed therein, said screwed section bolted to said screw hole.

4. The overhead tend apparatus of claim 1, each of said plurality of adjustable supports having an expansion link and a fixed support rod with through holes.

* * * * *